US011525314B2

(12) United States Patent
Young et al.

(10) Patent No.: US 11,525,314 B2
(45) Date of Patent: Dec. 13, 2022

(54) POLISHED ROD ELEVATORS, AND RELATED METHODS OF USE

(71) Applicants: Richard K Young, Debolt (CA); Alan D Voth, Peace River (CA)

(72) Inventors: Richard K Young, Debolt (CA); Alan D Voth, Peace River (CA)

( * ) Notice: Subject to any disclaimer, the term of this patent is extended or adjusted under 35 U.S.C. 154(b) by 0 days.

(21) Appl. No.: 16/930,964

(22) Filed: Jul. 16, 2020

(65) Prior Publication Data

US 2021/0340826 A1 Nov. 4, 2021

(51) Int. Cl.
*E21B 19/06* (2006.01)
*E21B 33/06* (2006.01)

(52) U.S. Cl.
CPC ..... *E21B 19/06* (2013.01); *E21B 33/06* (2013.01)

(58) Field of Classification Search
CPC ..... E21B 19/06; E21B 33/06
See application file for complete search history.

(56) References Cited

U.S. PATENT DOCUMENTS 1,196,647 A * 8/1916 Bergsten ..... E21B 19/06 294/91
2,592,168 A 4/1952 Morris et al.
3,343,409 A * 9/1967 Gibbs ..... E21B 47/008 73/152.61
4,479,537 A * 10/1984 Reed ..... E21B 33/047 166/85.4
4,560,327 A * 12/1985 Bez ..... F01B 31/00 417/493
4,761,120 A * 8/1988 Mayer ..... E21B 43/127 417/403
4,872,898 A * 10/1989 Enk ..... C03B 23/03 65/273
4,890,671 A * 1/1990 Baxter ..... E21B 19/06 166/250.01
9,963,945 B2 5/2018 Cayer
10,174,752 B2 1/2019 Downing
10,400,761 B2 * 9/2019 Robison ..... F04B 47/14
10,526,853 B2 1/2020 Cayer
10,731,446 B2 * 8/2020 Stachowiak ..... E21B 43/127
2004/0011530 A1 * 1/2004 Felthager, Sr. ..... E21B 19/06 166/85.1

(Continued)

FOREIGN PATENT DOCUMENTS

CA 2763162 8/2014

OTHER PUBLICATIONS

Wikipedia, Pumpjack, accessed Apr. 7, 2020, 4 pages, https://en.wikipedia.org/wiki/Pumpjack.

(Continued)

*Primary Examiner* — Aaron L Lembo
(74) *Attorney, Agent, or Firm* — Robert A. Nissen

(57) ABSTRACT

A polished rod elevator has a top lift platform defining a polished rod passage and a mouth to laterally receive a polished rod into the polished rod passage; a plurality of linear actuators depending below the top lift platform and radially spaced from an axis of the polished rod passage to define a production tree receiving gap; and a plurality of arcuate wellhead flange mounting base plates connected to base ends of the plurality of linear actuators. Related methods of use and kits are discussed.

23 Claims, 9 Drawing Sheets

(56) References Cited

U.S. PATENT DOCUMENTS

| | | | | |
|---|---|---|---|---|
| 2007/0261860 | A1* | 11/2007 | Hallonquist | E21B 19/086 166/381 |
| 2016/0237765 | A1* | 8/2016 | Koltiska | E21B 19/00 |
| 2016/0290074 | A1 | 11/2016 | Cayer | |
| 2017/0165812 | A1* | 6/2017 | Finnestad | B25B 7/123 |

OTHER PUBLICATIONS

Wikipedia, Christmas tree (oil well), accessed Apr. 7, 2020, 4 pages, https://en.wikipedia.org/wiki/Christmas_tree_(oil_well).
Baker Hughes, Lufkin Beam Pumping Units, believed to be available Mar. 2018, 105 pages.

* cited by examiner

POLISHED ROD ELEVATORS, AND RELATED METHODS OF USE

TECHNICAL FIELD

This document relates to polished rod elevators and related methods of use.

BACKGROUND

The following paragraphs are not an admission that anything discussed in them is prior art or part of the knowledge of persons skilled in the art.

Lifting devices exist for adjusting pump spacing of a production well. The lifting device rests directly on a well head flange and provides an expansive force between the flange and a temporary polish rod clamp or collet device attached to a polished rod extending into the well head. Such devices include first and second hydraulic cylinders for simultaneously lifting the polished rod to provide a gap between a carrier bar and a polished rod clamp. Feet engage single bolts in the well head flange.

SUMMARY

A polished rod elevator is disclosed comprising: a top lift platform defining a polished rod passage and a mouth to laterally receive a polished rod into the polished rod passage; a plurality of linear actuators depending below the top lift platform and radially spaced from an axis of the polished rod passage to define a production tree receiving gap; and a plurality of arcuate wellhead flange mounting base plates connected to base ends of the plurality of linear actuators.

A kit is disclosed comprising the parts of the polished rod elevator disconnected from one another.

A method is disclosed comprising: arranging a polished rod elevator on a wellhead, such that: arcuate flange mounting base plates seat upon a flange of the wellhead, linear actuators extend upward from each arcuate flange mounting base plate, and a top lift platform mounts to respective top ends of the plurality of linear actuators, with a polished rod extending out of a production tree on the wellhead and through a polished rod passage defined in the top lift platform; and extending the plurality of linear actuators to cause the top lift platform to one or more of lift or support the polished rod.

A method is disclosed comprising: assembling a plurality of arcuate flange mounting base plates about a tubing bonnet flange of a wellhead; connecting a plurality of linear actuators to the plurality of arcuate flange mounting base plates; and connecting a top lift platform to respective top ends of the plurality of linear actuators, in which a polished rod extends out of the wellhead and through a polished rod passage defined in the top lift platform.

In various embodiments, there may be included any one or more of the following features: Each of the plurality of arcuate wellhead flange mounting base plates define an array of flange bolt receivers. Each array of flange bolt receivers comprises six or more flange bolt receiving slots. Each of the plurality of arcuate wellhead flange mounting base plates form a semicircle arc. The plurality of arcuate wellhead flange mounting base plates collectively form a ring. Outer edges of each of the plurality of arcuate wellhead flange mounting base plates define radial tabs. A plurality of releasable connectors connecting the base ends of the plurality of linear actuators to the plurality of arcuate wellhead flange mounting base plates. The plurality of releasable connectors comprise pin and cotter pin connectors. Each of the plurality of arcuate wellhead flange mounting base plates have linear actuator receiving posts extending above a top face of the arcuate wellhead flange mounting base plate. Each of the linear actuators has a mounting plate secured at a top end of the linear actuator, with fasteners passed through the top lift platform into the mounting plate to secure the linear actuator to the top lift platform. A load sensor. The plurality of arcuate wellhead flange mounting base plates are tubing bonnet flange mounting base plates. There are two linear actuators and two arcuate wellhead flange mounting base plates. The plurality of linear actuators comprise hydraulic cylinders. The elevator is mounted to a tubing bonnet flange with a production tree received within the production tree receiving gap between the plurality of linear actuators. The top lift platform contacts a rod clamp on the polished rod to support the weight of and to lift the polished rod. Connecting a temporary rod clamp to the polished rod above the top lift platform, in which during extending the top platform contacts the temporary rod clamp to one or more of lift or support the polished rod. While the polished rod is supported by the polished rod elevator, sliding a stuffing box in the production tree up the polished rod; connecting a lower temporary rod clamp to the polished rod below the stuffing box; releasing the top lift platform from around the polished rod; and sliding the stuffing box off of a top end of the polished rod. Placing a serviced or new stuffing box on the polished rod above the lower temporary rod clamp; operating the rod lift elevator to cause the top lift platform to support the polished rod; removing the lower temporary rod clamp; and securing the serviced or new stuffing box to the production tree. While the polished rod is supported by the polished rod elevator, sliding a stuffing box and rod blowout preventer in the production tree up the polished rod; connecting a lower temporary rod clamp to the polished rod below the rod blowout preventer; releasing the top lift platform from around the polished rod; and sliding the stuffing box and rod blowout preventer off of a top end of the polished rod. Placing a) the rod blowout preventer or a new rod blowout preventer and b) the stuffing box or a new stuffing box, on the polished rod above the lower temporary rod clamp; operating the rod lift elevator to cause the top lift platform to support the polished rod; removing the lower temporary rod clamp; and securing the rod blowout preventer and the stuffing box to the production tree. While the polished rod is supported by the polished rod elevator, disengaging a permanent rod clamp from the polished rod, the permanent rod clamp being located at a first position above a carrier bar of a pump jack; securing the permanent rod clamp or a new permanent rod clamp to the polished rod in a new position different from the first position to adjust a stroke of the polished rod. The stroke is adjusted such that the polished rod soft taps a bottom hole pump connected to the polished rod at a base of the stroke. The plurality of linear actuators are operated to remove a gas lock in a bottom hole pump connected to the polished rod. Arranging further comprises: assembling the arcuate flange mounting base plates about a tubing bonnet flange of the wellhead; connecting the linear actuators to the arcuate flange mounting base plates; and connecting the top lift platform to the top ends of the linear actuators.

The foregoing summary is not intended to summarize each potential embodiment or every aspect of the subject matter of the present disclosure. These and other aspects of the device and method are set out in the claims.

BRIEF DESCRIPTION OF THE FIGURES

Embodiments will now be described with reference to the figures, in which like reference characters denote like elements, by way of example, and in which:

FIGS. 2A and 2B are top plan views of the temporary rod clamp of FIG. 2 engaging a polished rod.

DETAILED DESCRIPTION

Immaterial modifications may be made to the embodiments described here without departing from what is covered by the claims.

In the life of an oil well there are several phases—drilling, completion, production, and abandonment. Once a well has been drilled, it is completed to provide an interface with the reservoir rock and a tubular conduit for the well fluids. Well completion is a generic term used to describe the installation of tubulars and equipment required to enable safe and efficient production from an oil or gas well. The production phase occurs after successful completion, and involves producing hydrocarbons through the well from an oil or gas field.

Figure 1:
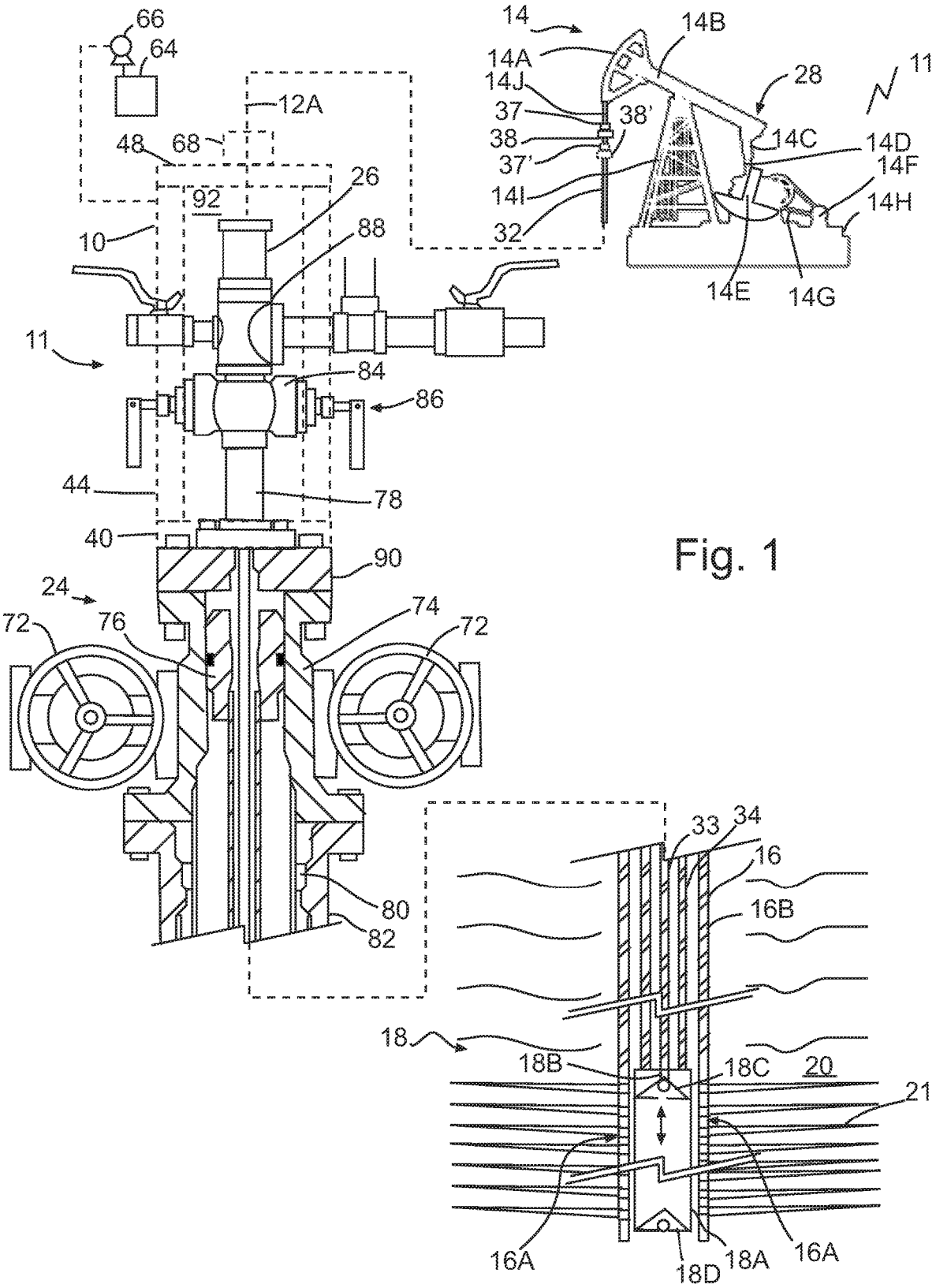
FIG. 1 is a side elevation schematic illustrating a production well, in sequence from top to bottom, a pump jack, a production wellhead with a polished rod elevator positioned thereon, and a bottom hole pump depending from the wellhead via tubing.

Referring to FIG. 1, a production wellhead assembly 11 is illustrated. The assembly 11 is an assembly of components that form the surface termination of a wellbore and includes various production equipment at the surface. A production wellhead assembly may include spools, valves, manifolds, and assorted adapters that provide pressure control of a production well.

The assembly 11 may incorporate various components, such as a casing spool or bowl 82, for internally mounting a casing hanger 80 during the well construction phase. The casing hanger 80 suspends a casing string 16B, which may be steel pipe cemented in place during the construction process to stabilize the wellbore (well 16). The wellhead or bowl 82 may be welded onto the outer string of casing 16B, which has been cemented in place during drilling operations, to form an integral structure of the well.

The assembly 11 may include surface flow-control components, such as the group of components that are sometimes collectively referred to as a Christmas tree or production wellhead tree 12. The tree 12 may installed on top of the casing spool or bowl 82, for example with isolation valves 86, and choke equipment such as production valves 72 to control the flow of well fluids during production. Other components such as a flow manifold 88, also known as a flow tee, a bonnet 90 and a rod blowout preventer (BOP) 84 may be provided as part of the production wellhead assembly 11. Manifold 88, bonnet 90, and BOP 84 may be mounted on a spool 78 mounted on the tubing head 74. The flow manifold 88 may direct produced fluids to processing or storage equipment, such as a surface production tank (not shown) or a pipeline (not shown).

The production wellhead assembly 11 may incorporate a means of hanging a production tubing string 34. For example, the assembly 11 may include a tubing head 74 mounted on the casing spool or bowl 82, the tubing head 75 internally mounting a tubing hanger 76. A tubing hanger 76 is a component used in the completion of oil and gas production wells. It may be set in the Christmas tree 12 or the wellhead 24 and suspends the production tubing string 34 and/or casing. In petroleum and natural gas extraction, a Christmas tree, or "tree", is an assembly of valves, spools, and fittings used to regulate the flow of pipes in an oil well, gas well, water injection well, water disposal well, gas injection well, condensate well and other types of wells. It was named for its resemblance to the series of starting lights at a drag racing strip, called by that name. Sometimes the tubing hanger 76 provides porting to allow the communication of hydraulic, electric and other downhole functions, as well as chemical injection. The tubing hanger 76 may also serve to isolate the annulus and production areas. The production tubing string 34 may run the length of the well 16 to the bottom hole pump (BHP) 18, and serves to isolate the tubing string 34 interior from the annulus for production up the interior of the tubing string 34.

When an oil well is first completed, the fluids (such as crude oil) may be under natural pressure that is sufficient to produce on its own. In other words, the oil rises to the surface without any assistance.

Referring to FIG. 1, in many oil wells 16, and particularly those in oil bearing formations 20 that are established and aging, natural pressure may decline to the point where the oil must be artificially lifted to the surface. In the case of most wells 16, stimulation treatments such as fracturing treatments may be carried out in addition to the use of artificial lift solutions, creating sand/particulate-propped porous fractures 21 that extend from perforations 16A in the well 16. A production wellhead assembly 11 may connect to or house part of an artificial lift system such as a reciprocating rod pump or drive. An artificial lift is a system that adds energy to the fluid column in a wellbore with the objective of initiating and improving production from the well. Artificial-lift systems use a range of operating principles, including rod pumping, gas lift and electric submersible pump. A reciprocating rod drive, such as a pump jack 14, is an artificial-lift pumping system that uses a surface power source to drive a pump 18. A beam and crank assembly in the pump jack 14 converts energy, for example in the form of rotary motion from a prime mover, into a reciprocating motion in a sucker-rod string 33 that connects to a BHP assembly (pump 18). The BHP may contain a plunger and valve assembly to convert the reciprocating motion to vertical fluid movement.

Referring to FIG. 1, a subsurface pump, such as a bottom hole pump 18, may be located in the well 16 below the level of the oil. A string 33 of sucker rods may extend from the pump 18 up to the surface 22 to a pump jack 14. The pump jack 14 acts to reciprocate the sucker rod string 33 to operate the bottom hole pump 18. A pump jack 14 is also known as an oil horse, donkey pumper, nodding donkey, pumping unit, horsehead pump, rocking horse, beam pump, dinosaur, grasshopper pump, Big Texan, thirsty bird, or jack pump in some cases. A pump jack or other artificial lift system may be used to mechanically lift liquid out of the well when there is not enough bottom hole pressure for the liquid to flow all the way to the surface. Pump jacks are commonly used for onshore wells producing little oil.

A pump jack 14 may operate in a suitable fashion with suitable parts. A donkey head 14A (also known as a horsehead) may be mounted to an end of a walking beam 14B, that is mounted to pivot on a Samson post 141 or other structural frame, which may be mounted on a skid or other suitable base 14H. A pitman arm 14C may connected to a counterweight 14D, which may connect via a crank 14E to a gear reducer 14G. A prime mover 14F, such as a gasoline or diesel engine, or an electric motor, on the surface 22 may be connected to supply power in the form of rotational mechanical energy to the gear reducer 14G. The gear reducer 14G may rotate the crank 14E, causing the counterweight 14D to rotate and the pitman arm 14C to apply a reciprocating motion on the walking beam 14B, cause the walking beam 14B of the pump jack 14 to rock back and forth. The horse head 14A may have an arcuate or angled upper face that lifts and lowers a bridle 14J. The bridle 14J may be secured to a carrier bar 38, which seats below and contacts the underside of a rod clamp 37 that is secured to a polished rod 32. The polished rod 32 passes through a stuffing box 26 to enter the wellbore. The polished rod 32 is the uppermost joint in the sucker rod string 33 used in a rod pump 18 artificial-lift system. The polished rod 32 has a smooth, polished outer surface, and a straight carefully machined cylindrical wall to enable an efficient hydraulic seal to be made by the stuffing box 26 around the reciprocating rod string. Thus, the polished rod 32 is able to move in and out of the stuffing box 26 without production fluid leakage. The bridle 14J follows the curve of the horse head 14A as it lowers and raises to create a nearly vertical stroke. The polished rod 32 is connected to a long string 33 of rods called sucker rods, which run through the tubing string 34 to the down-hole pump 18, which may be positioned near the bottom of the well 16 or other oil-producing zone in the well 16. By reciprocating the horsehead 14A, the rod string 33 is lifted and lowered to produce a pumping action in pump 18 to lift oil to the surface.

The bottom hole or subsurface pump 18 may operate by suitable mechanics. In the example shown, the pump 18 may have a plunger 18B that is reciprocated inside of a pump barrel 18A by the sucker rods. The barrel 18A may have a standing one-way valve 18D adjacent a downhole end, while the plunger 18B may mount a one-way valve, called a travelling valve 18C. Alternatively, in some pumps the plunger has a standing one-way valve, while the barrel has a traveling one-way valve. Relative movement alternatively charges the pump barrel 18A, between the standing and travelling valves, with a charge or increment of fluid and then transfers the charge of fluid uphole through the tubing string 34. The one-way valves open and close according to pressure differentials across the valves. In the embodiments of this document, any suitable bottom hole or subsurface pump may be used.

Subsurface pumps 18 may be generally classified as tubing pumps or insert pumps. A tubing pump (shown) may include a pump barrel 18A, which is attached to the end joint of a well tubing string 34. The plunger 18B may be attached to the end of the rod string 33 and inserted down the well tubing string 34 and into the barrel 18A. Tubing pumps may be generally used in wells with high fluid volumes. An insert pump (not shown) may have a relatively smaller diameter and is attached to the end of the rod string and run inside of the well tubing to the bottom. The non-reciprocating component is held in place by a hold-down device that seats into a seating nipple installed on the tubing. The hold-down device also provides a fluid seal between the non-reciprocating barrel and the tubing.

Servicing a production wellhead tree presents logistical and practical challenges. The polished rod 32 and rod string 33 will usually extend several kilometers into the ground. If the rod string is required to be removed to carry out the servicing, then a crane or servicing rig is required to pull the rod out of the well. The rod must be carefully removed so as not to accidentally drop any part of it down the well, damaging the well or bottom hole equipment. In order to make stroke changes to a pump jack, a servicing rig may be called out to support the upper end of the rod string while the safety clamp (permanent rod clamp above the carrier bar) is adjusted. A service rig may include a mobile platform loaded with oil industry service equipment that can be driven long distances within the oil fields to service wells. There are several specialized types of service rigs: the carrier, the pump truck, the doghouse, a 5-ton equipment truck and several crew vehicles. The rigs may travel in a convoy, because all of the component rigs may be needed for proper oil well servicing. The crew use the equipment on the rigs to provide a variety of services, including completions, workovers, abandonment, well maintenance, high-pressure and critical sour-well work and re-entry preparation. Calling a servicing rig to a well site is a relatively expensive and involved affair.

Figure 2:
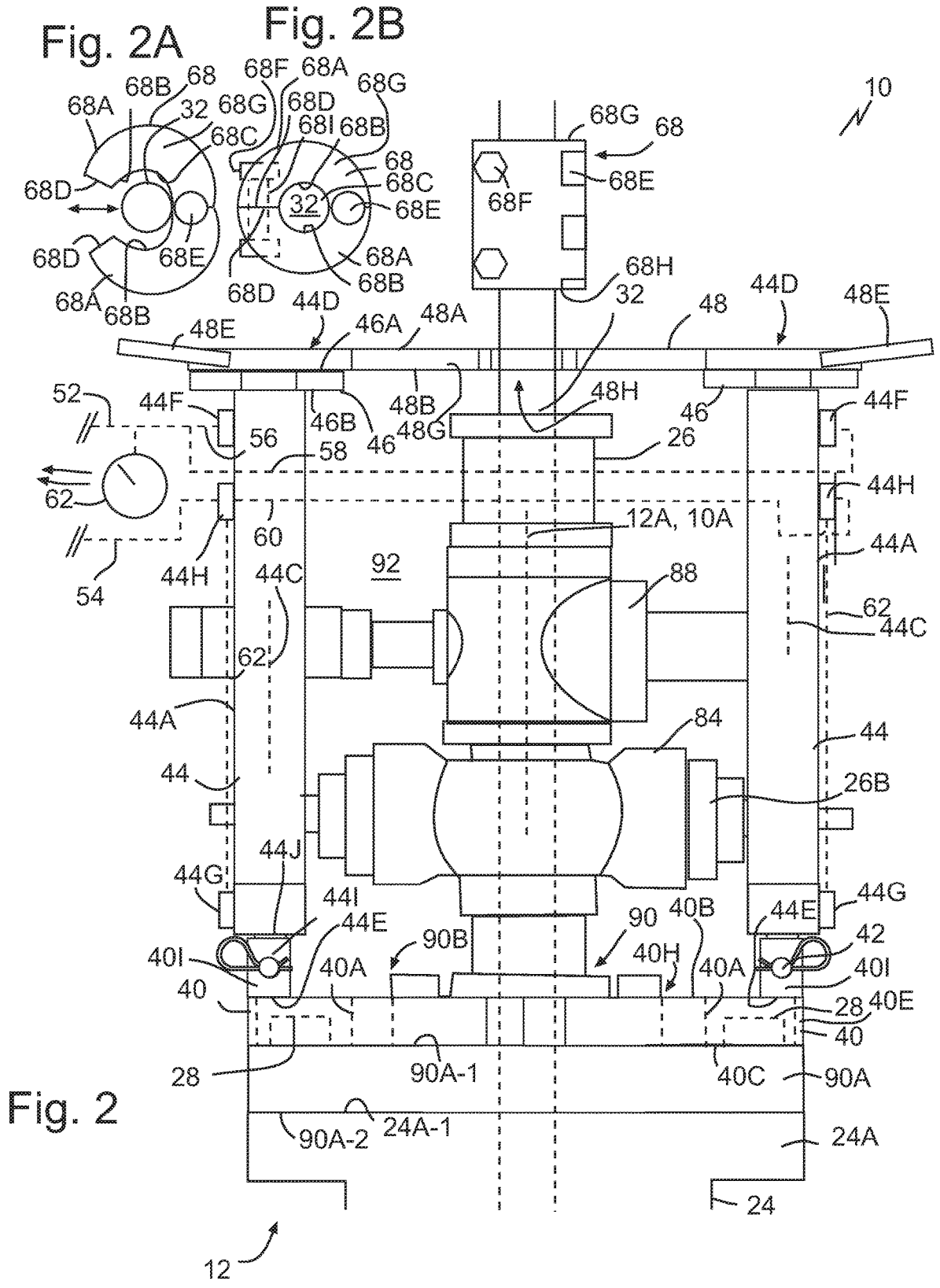
FIG. 2 is a side elevation view of a polished rod elevator mounted on a tubing bonnet of a well head, with a temporary rod clamp secured to the polished rod, and a production tree located between linear actuators of the polished rod elevator. For simplicity, parts of the production tree are omitted such as valve handles and flow lines.
Figure 3:
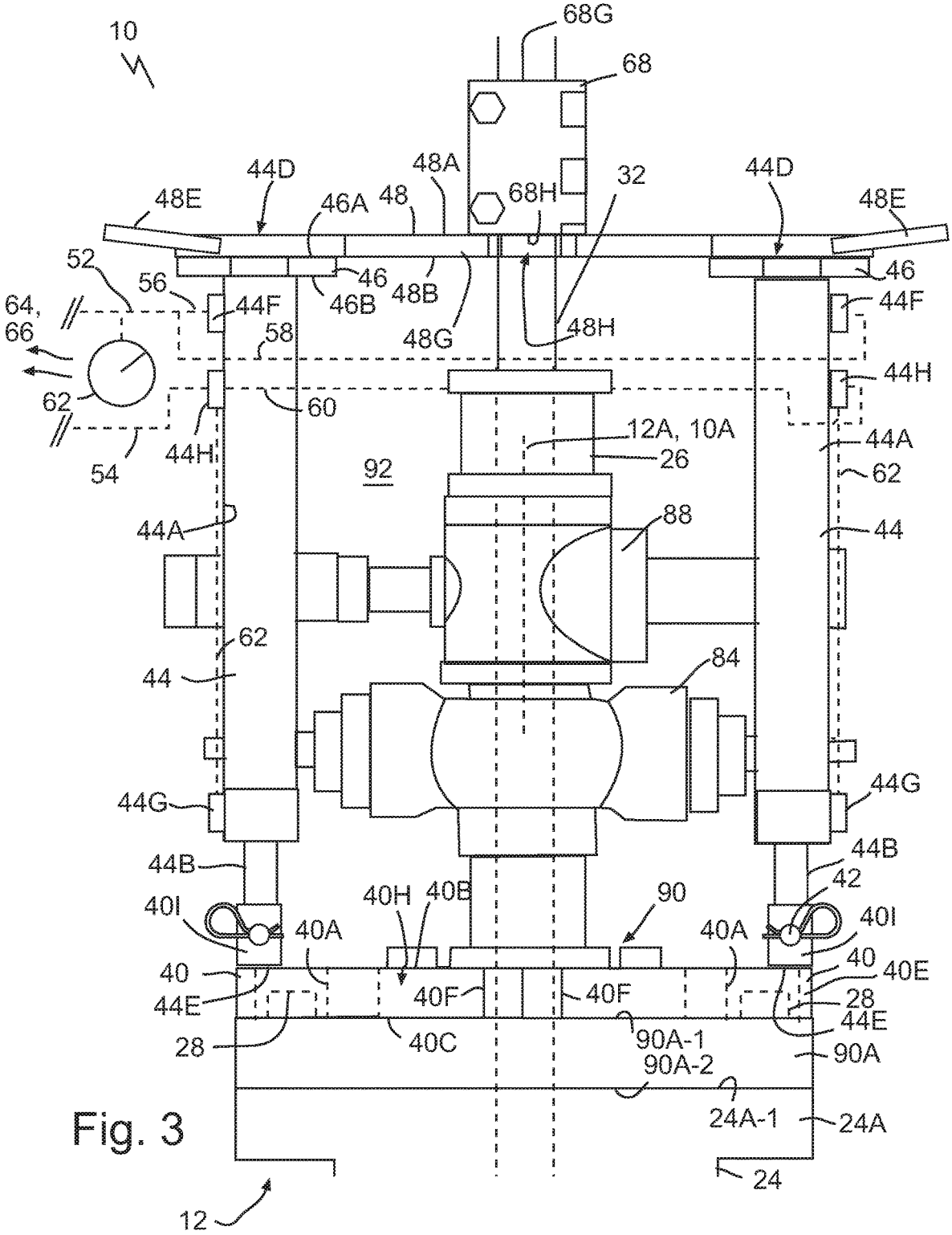
FIG. 3 is a side elevation view of the polished rod elevator and well head combination of FIG. 2, with the polished rod elevator lifting the polished rod by applying upward force to the temporary rod clamp.

Referring to FIGS. 1 and 2, a polished rod elevator 10 is illustrated. The elevator 10 may have a top lift platform 48, a plurality of linear actuators 44, and a plurality of arcuate wellhead flange mounting base plates 40. The top lift platform 48, which may function similar to a carrier bar, may define a polished rod passage 48K. The platform 48 may defined a mouth 48H to laterally receive a polished rod 32 into the polished rod passage 48K. The linear actuators 44 may depend below the top lift platform 48. The actuators 44 may be radially spaced from an axis 10A of the polished rod passage 48K to define a production tree receiving gap 92. The arcuate wellhead flange mounting base plates 40 may be connected to base ends 44E of the plurality of linear actuators 44. In use, the polished rod elevator 10 may be arranged on a wellhead 24. The arcuate flange mounting base plates 40 may seat upon a flange, such as a base flange 90A of a tubing bonnet 90, of the wellhead 24. Linear actuators 44 may extend upward from each arcuate flange mounting base plate 40. The top lift platform 48 may mount to respective top ends 44D of the plurality of linear actuators 44. A polished rod 32 may extend out of a production tree 12 on the wellhead 24 and through a polished rod passage 48K defined in the top lift platform 48. Referring to FIGS. 2-3, the plurality of linear actuators 44 may be extended in operation to cause the top lift platform 48 to one or more of lift or support the polished rod 32.

Figure 7:
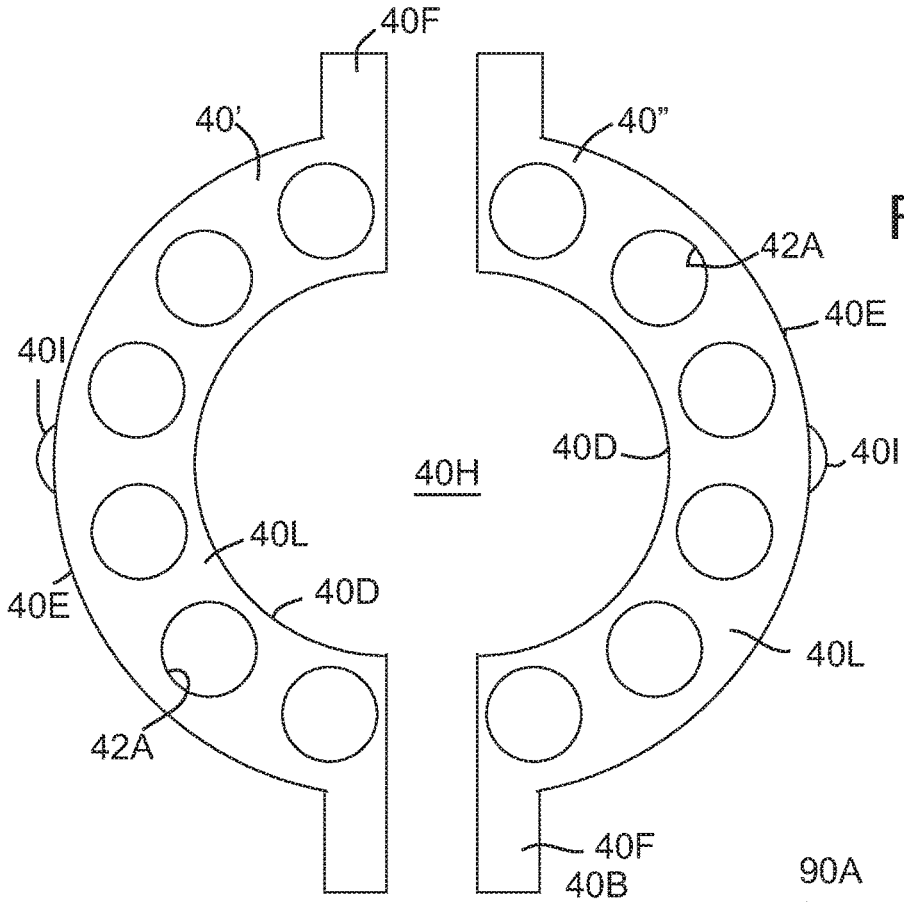
FIG. 7 is a top plan view of a separated pair of arcuate wellhead flange mounting base plates used in the polished rod elevator of FIG. 2.
Figure 8:
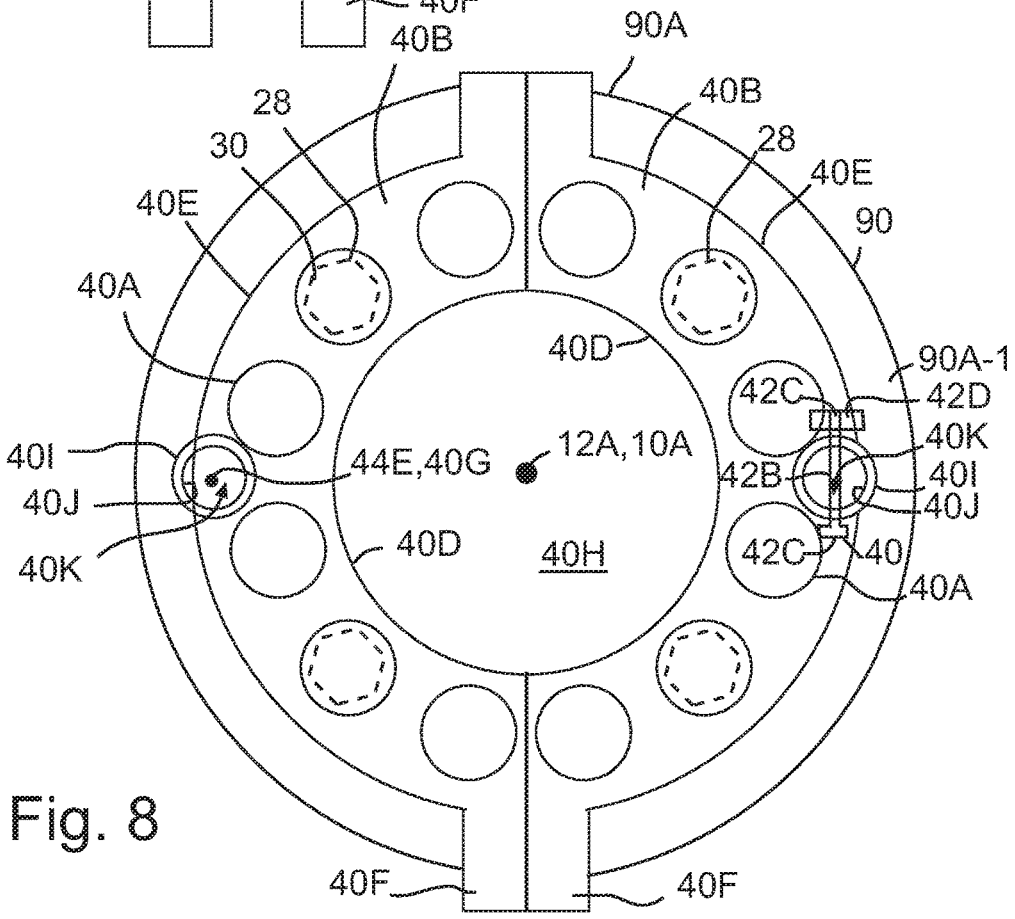
FIG. 8 is a top plan view of a pair of arcuate wellhead flange mounting base plates brought together in an operating configuration to be used in the polished rod elevator of FIG. 2.

Referring to FIGS. 2 and 7-8, the arcuate flange mounting base plates 40 may be structured to engage with or accommodate flange bolts 28 of the wellhead flange upon which the plates 40 sit in use. Each of the plurality of arcuate wellhead flange mounting base plates 40 may define an array of flange bolt receivers, such as recesses or slots 40A. The receivers may be patterned in an array to follow the circumferential array of bolts 28 in a circular wellhead flange to flange connection. Bolts in this document also refer to nuts. In the example shown each array of flange bolt receivers comprises six or more flange bolt receiving slots 40A. Each slot 40A may be shaped to receive a head of a bolt 28, for example slots 40A may be circular as shown in cross-section, although other shapes may be used. The slots 40A may extend partway or, as in the example shown, completely through the plates 40 from an upper face 40B to a base face 40C of each plate 40. In some cases, no nuts or bolts 28 are present, and the plates 40 rest or seat upon the corresponding wellhead flange.

Referring to FIGS. 2 and 7-8, the arcuate or C-shaped plates 40 may have a suitable shape. Each of the plurality of arcuate wellhead flange mounting base plates 40 may form a partly circular arc, for example a semicircle arc. In the example shown, the plurality of arcuate wellhead flange mounting base plates 40 are structured to assemble on the upper face 90A-1 of the flange 90A to form a ring (FIG. 8 best shows the ring). The arcuate shape may refer to the shape of an inside edge 40D, although in some cases both the inside edge 40D and an outside edge 40E may be arcuate. The inside edges 40D of each plate 40 may collectively define a production tree receiving gap 40H.

Referring to FIGS. 2 and 7-8, the plates 40 may be shaped to accommodate various peculiarities in the arrangement of parts on any particular wellhead 24 upon which it is desired to mount the elevator 10. In the example of FIG. 2, the gap 40H receives an upper flange 90B of a tubing bonnet 90 upon which the plates 40 sit (thus making the plates 40 tubing bonnet flange mounting base plates). The use of an arcuate base plate 40 may be advantageous as it allows the plate 40 to assemble around the wellhead flange 24 below the production tree 12 in various configurations as may be needed to ensure that the actuators 44 may be oriented vertically or otherwise upright to function in a lifting capacity. The combination of discrete incremental slots 40A and arcuate shape may permit the plates 40 to be rotated clockwise or counterclockwise about a range of angular positions in order to find a suitable arrangement from which to locate and assembly the remaining parts of the elevator 10. The use of arcuate base plates 40 may also provide a stable base for each actuator 44 to support the actuator 44 in an upright position, by providing sufficient lateral support by extending laterally to the sides of the plates 40. Although any number of plates 40 and actuators 44 may be used, in the example shown there are two linear actuators and two arcuate wellhead flange mounting base plates.

Referring to FIGS. 7-8, the base plates 40 may incorporate tabs. For example, outer edges 40E of each of the plurality of arcuate wellhead flange mounting base plates 40 may define radial tabs 40F. In the example shown, respective tabs 40F extend from, at, or near, opposed ends of each plate 40. Such tabs 40F may provide surfaces from which the plates 40 may be manipulated, for example to assist in positioning the plates 40 or to assist in removing the plates 40 from around a wellhead flange 24 once the elevator 10 is being disassembled and removed.

Referring to FIGS. 2-6, the elevator 10 may incorporate suitable linear actuators. A linear actuator may refer to an actuator that creates motion in a straight line or axis, in contrast to a deviated motion or even the circular motion of a conventional electric motor. Linear actuators are used in machine tools and industrial machinery, in computer peripherals such as disk drives and printers, in valves and dampers, and in many other places where linear motion is required. In the example shown, a pair of hydraulic cylinders are used. Each cylinder may have a cylindrical housing 44A in which reciprocates a piston 44B. In the example shown, the pistons 44B define the base ends 44E of the actuators 44, while the cylindrical housing 44A defines the top end 44D, although this orientation may be reversed so that the pistons 44B define the top ends 44D and the housings 44A define the base ends 44E. Each actuator 44 extends and retracts along a respective axis 44C of travel. The actuators 44 may be mounted and radially spaced from one another about an axis 10A, with a production tree 12 received within a production tree receiving gap 92 defined between the plurality of linear actuators 44. In other cases, screw jacks, magnetic devices, worm gears, ratchet systems, and other suitable linear actuators may be used. A locking system may be used to lock each actuator 44 in a particular position for safety and efficiency purposes.

Referring to FIGS. 1-3, the linear actuators 44 may be powered by a suitable power source. In the example shown, a hydraulic power source is used, for example comprising a reservoir 64 of hydraulic fluid, and a pump 66. Referring to FIGS. 2-3, hydraulic fluid may be supplied and returned to the reservoir 64 via lines 52 or 54 depending on whether the actuators 44 are extending or retracting. In the example shown, a group of lines 52, 56, and 58, and a group of lines 54, 60, and 62, may each form respective manifolds that simultaneously feed each actuator 44 in parallel, for equal effect assuming all other features of the actuators 44 are equal. Quick connect fittings or other connectors may be used to connect lines to components, such as to ports 44F, 44H, and 44G. In the example shown, supplying fluid to ports 44F will cause the actuators 44 to extend, while supplying fluid to ports 44G will retract the actuators 44. In other cases, an electrical power source may be used, for example in the case of screw jack actuators.

Referring to FIGS. 2-3, a load sensor 62 may be provided. A load sensor, in this case a hydraulic pressure gauge, may be used to sense load on the system. The ability to sense load provides the operator with feedback vital to the operation of the elevator 10, as relatively high pressures will indicate that the rod is supported by the elevator 10, and extremely high pressures will indicate that the elevator 10 is in danger of failure or damage, possibly because some part of the system is stuck.

Figures 5, 5A:
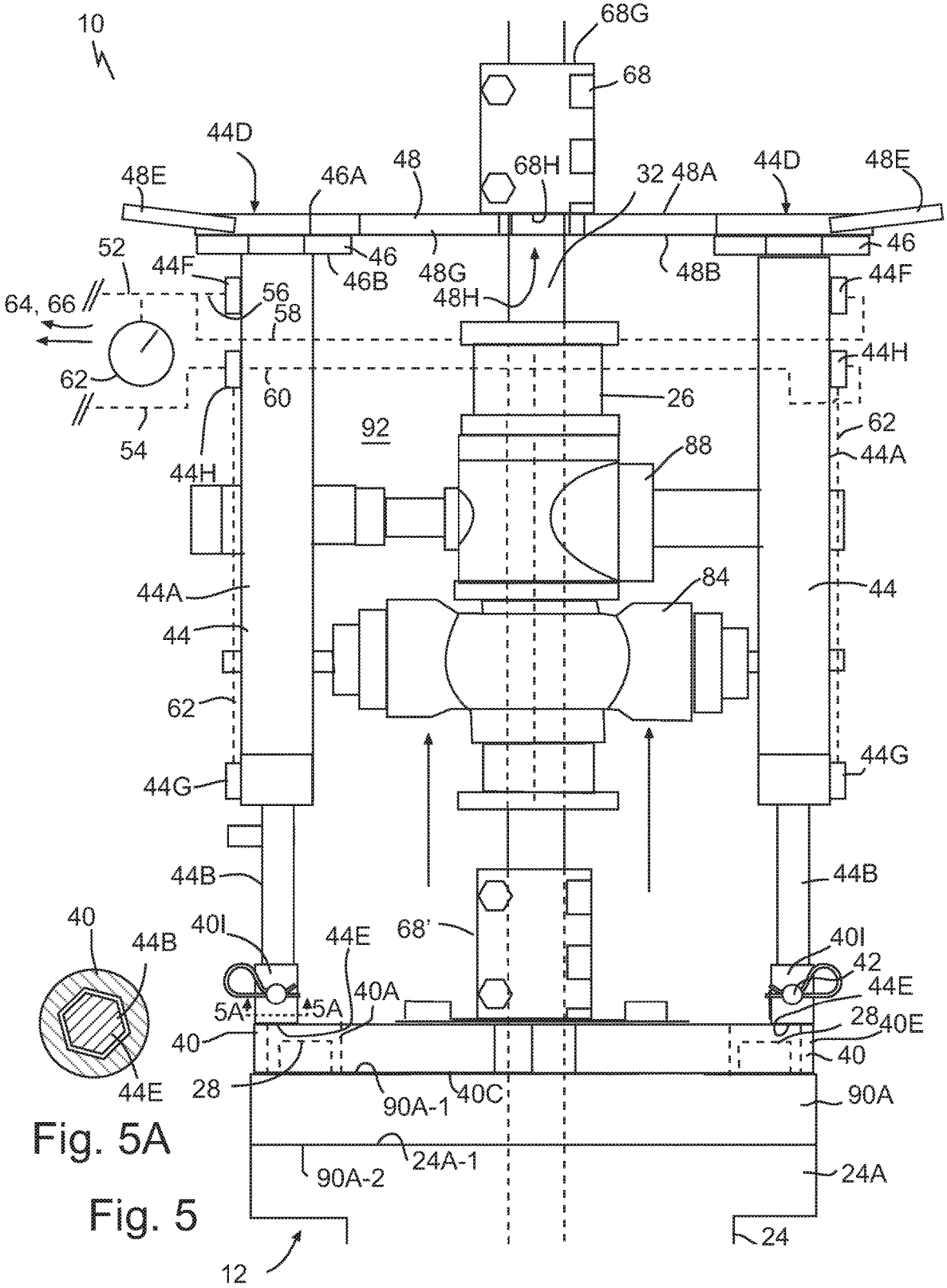
FIG. 5 is a side elevation view of the polished rod elevator and well head combination of FIG. 2, with the polished rod elevator supporting the polished rod while a second temporary rod clamp is installed below the stuffing box to permit the stuffing box to be removed or replaced.
FIG. 5A is a section view taken along the 5A-5A section lines of FIG. 5.

Referring to FIGS. 2, and 6-8, the actuators 44 may connect to the base plates 40 in a suitable fashion. In the example shown, a plurality of releasable connectors, such as post 401, may be provided to connect the base ends 44E of the plurality of linear actuators 44 to the plurality of arcuate wellhead flange mounting base plates 40. Each of the plurality of arcuate wellhead flange mounting base plates 40 may have linear actuator receiving posts 401, for example that each define a piston receiving bore 40J, extending above a top face 40B of the arcuate wellhead flange mounting base plate 40. A variety of suitable connection systems may be used. In this example, the plurality of releasable connectors may comprise pin 42 and cotter pin 42D connectors. The base ends 44E of each actuator 44 may define a stem 44J that is structured to be received in the bore 40J. When received, respective pin holes 441 and 40L in the stem 44J and post 401 may align to receive a pin 42 therebetween. Each pin 42 may have a pin body 42A that passes through the holes 441 and 40L, a head 42B, a cotter pin hole 42C in a terminal end of the pin 42, into which a cotter pin 42D or other suitable fastener is received to secure the pin 42D and hence the actuators 44 to the respective base plate 40. In other cases, a quick connector is used, such as a cam lock, a push fit, or other types of quick connect fittings. Referring to FIG. 5A, the piston 44B and posts 401 may be structured to mate in a non-rotatable fashion, for example the base end 44E of the piston 44B may have a non-circular profile such as a polygonal shape that mates with a non-circular inner shape of post 44E—in other cases splines or pins may be used to prevent rotation.

Figure 6:
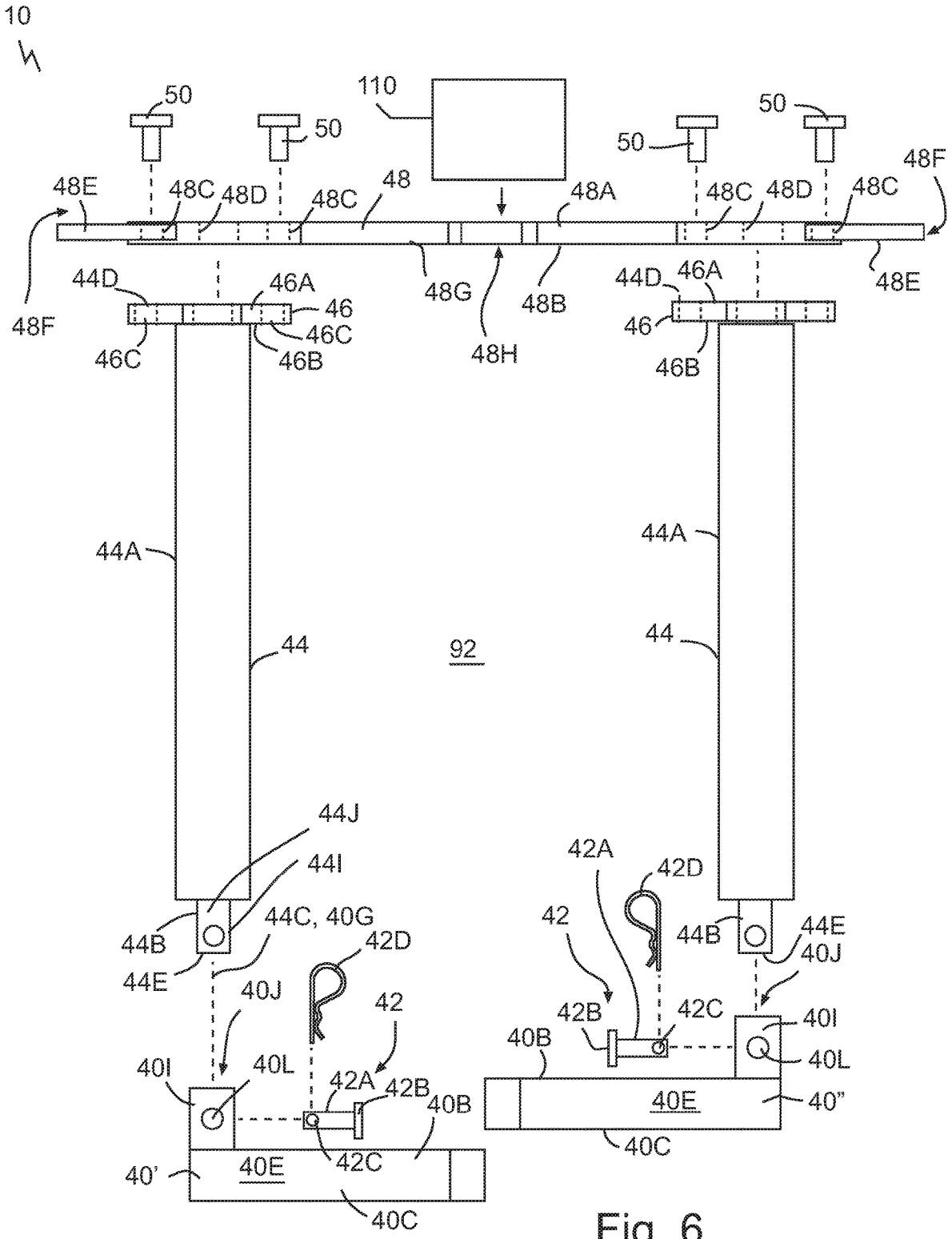
FIG. 6 is an exploded side elevation view of the polished rod elevator of FIG. 2.
Figure 9:
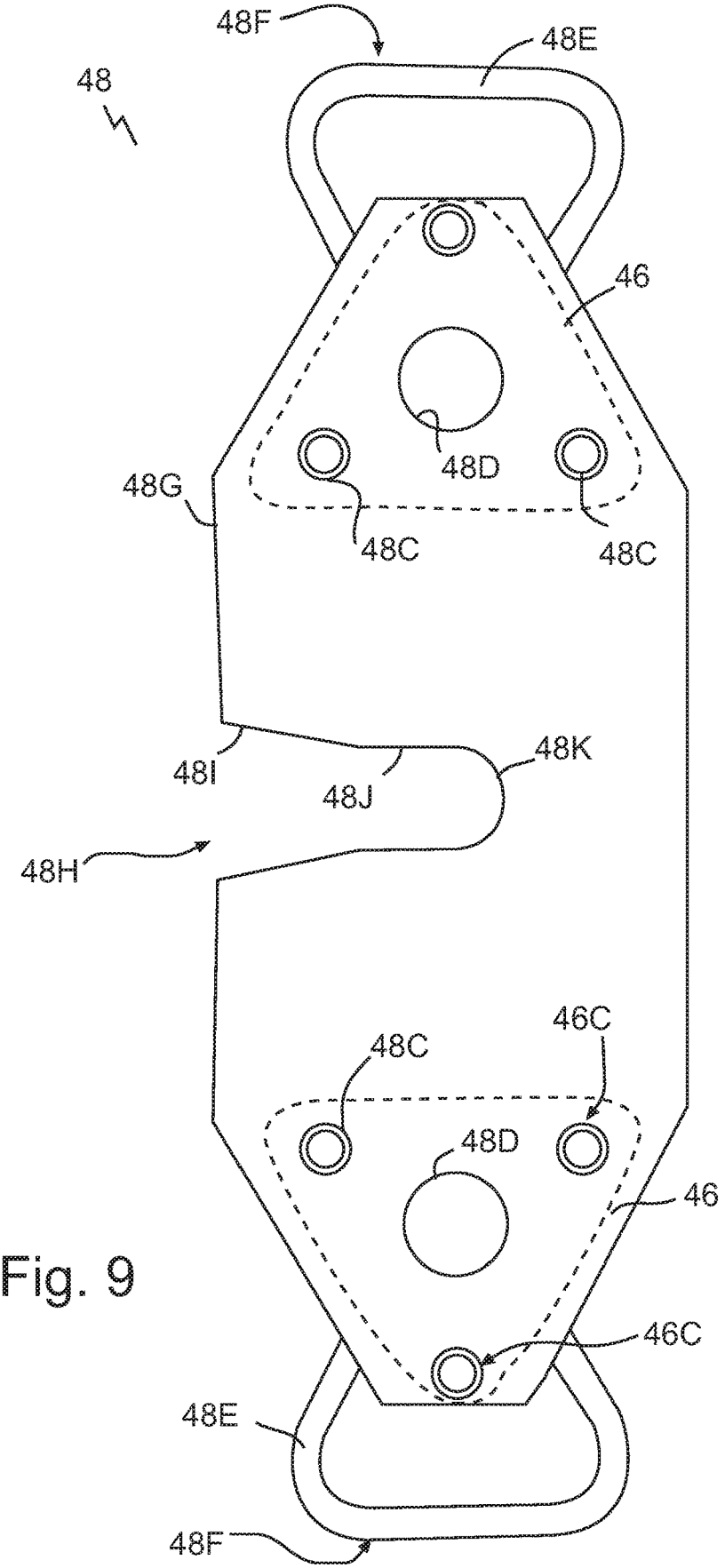
FIG. 9 is a top plan view of a top lift platform used in the polished rod elevator of FIG. 2, with example dimensions of the mounting plates from the top ends of the linear actuators shown in dashed lines.

Referring to FIGS. 2, 6, and 9 a suitable top lift platform 48 may be used in the elevator 10. The platform 48 may function similar to a carrier bar 38 (FIG. 1), in that it travels along the rod 32 without actually engaging it outside of the use of a rod clamp. The platform 48 have be a plate, for example a planar shaped plate with opposed upper and lower faces 48A and 48B, respectively, defining a peripheral edge 48G. A lateral mouth 48H may extend laterally inward from edge 48G, forming a throat 48J into a polished rod passage 48K. The mouth 48H may have a tapered entry 481 to guide the rod 32 into place, or more accurately, to guide the platform 48 into place around the rod 32. In the example shown, two linear actuators 44 are used, for example in such an arrangement that the actuators 44 depend from opposed longitudinal ends 48F in a plane the passes through a polished rod axis 10A defined by the polished rod passage 48K. The platform 48 is an example of a structural frame structured to connect to the actuators 44 while being able to seat under and lift an appropriate lifting structure on the rod 32, such as a temporary rod clamp. The platform 48 may have other suitable features, such as lateral handles 48F. 13.

Referring to FIGS. 2, 6, and 9, the linear actuators 44 may connect to the platform 48 via a suitable mechanism. In the example shown, a plurality of releasable connectors, such as bolts 50 and corresponding aligned bolt holes 48C and 46C in the platform 48 and mounting plates 46 of the actuator 44, may be used. Bolt holes 48D for the cylinders or actuators 44 themselves may be used. Each of the linear actuators 44 may have a mounting plate 46 secured at a top end 44D of the linear actuator 44. Fasteners such as bolts 50 may be passed through the top lift platform 48 into the mounting plate 46 to secure the linear actuator 44 to the top lift platform 48. A variety of suitable connection systems may be used. In some cases, a quick connector is used, such as a cam lock, a push fit, or other types of quick connect fittings. The mounting plates 46 may have relatively wider lateral dimensions than the top ends 44D of the actuators 44, thus improving the strength and stability of the elevator 10 by providing a brace function in the connection of the two parts. The mounting plates 46 may be releasably connected to the actuators 44 or may be permanently mounted, such as welded, adhered, glued, or otherwise.

Referring to FIGS. 2 and 6, the elevator 10 may be structured to assembly about the production tree 12 in use. For example in a method of use, the elevator 10 may be arranged about the wellhead 24. The arcuate flange mounting base plates 40 may be assembled about a flange, such as a tubing bonnet flange 90A, of the wellhead 24. The linear actuators 44 may be connected to the arcuate flange mounting base plates 40, for example by inserting stems 44J of each actuator 44 into the respective bores in posts 401, and using pins 42 and cotter pins 42D to secure the actuators 44 to the plates 40. The top lift platform 48 may be connected to the top ends 44D of the linear actuators 44, for example by bolting the mounting plates 46 to the platform with bolts 50.

Referring to FIGS. 2, 2A and 2B the elevator 10 may in use cooperate with a temporary rod clamp 68 to lift the rod 32. A temporary rod clamp 68 may be connected to the polished rod 32, for example above the top lift platform 48. Referring to FIG. 3, during extending of the actuators 44, the top platform 48 may contact the temporary rod clamp 68 to one or more of lift or support the polished rod 32. Once the top lift platform 48 contacts the rod clamp 68 on the polished rod 32, the platform 48 and actuators 44 may support the weight of and or lift the polished rod 32.

Referring to FIGS. 2A-2B, the temporary rod clamp 68 may have a suitable design. In the example shown, a clamshell grip connector is used. The clamp 68 may comprise a pair of arcuate jaws 68A or portions who converge together about a hinge 68E to converge respective jaw tips 68D to close a mouth defined by the open jaws. Inner side walls 68B of each jaw 68A may be structured to collectively define a rod passage 68C, and to grip the rod 32 that extends through that passage 68C in use. A lock or clamp may be used, such as a locking bolt 68F that passes through respective lateral bores 681 in each jaw 68A and tightens the grip of the jaws 68A upon the rod 32 when the bolt 68F is turned. Each clamp 68 may define a top end 68G and a base end 68H. In use the base end 68H is contacted by and seats upon the platform 48 during lifting or supporting.

Referring to FIG. 6, the elevator 10 may be provided in a suitable form, such as a kit. A kit may comprise the parts of the polished rod elevator 10 disconnected from one another. Written instructions may be provided in association with the kit. Interchangeable attachments may be provided for each actuator 44, for example for lengthening or shortening the actuators 44 or their respective strokes. Interchangeable arcuate base plates 40 may be provided, for example in different sizes to accommodate different wellhead flanges.

The successful operation of the polished rod 32 requires a tight seal between the polished rod 32 and the seals (not shown) of the stuffing box 26. If the polished rod 32 becomes damaged, for example scored, the rod 32 must be replaced before damage is done to the stuffing box 26. In some cases the seals also must be replaced. Damage to the polished rod 32 may be caused by various reasons. In one case, a poorly tapped stroke may lead to damage to the stuffing box 26. Damage may also come from continued contact with internal components of the production wellhead assembly 11. In a perfectly vertical well, and even a well nominally deviated from vertical near the surface, the polished rod 32 reciprocates without contacting anything but the stuffing box seals. However, in some wells that deviate from true vertical measured with respect to the surface of the earth, the rod 32 may be drawn to one side where contact can occur. Deviation is less of a concern the further from the surface the deviation is, but in many cases such deviation occurs before the first rod centralizer on the sucker rod string 33.

A fluid leak may be caused if damage is done to the rod 32, such leak leading to potential environmental damage and cleanup cost. Production wellheads are often unmanned and in remote areas in many cases, and thus, even a relatively small fluid leak carries a potential for devastation because the leak may go unnoticed for days and sometimes weeks. Replacing the rod 32 requires a well service entity to kill the well, lift the damaged rod 32 out of the well, connect a new polished rod 32 to the sucker rod string 33, and repair any damaged seals in the stuffing box 26 before connecting the new rod 32 to the pump jack 14. In many cases the new rod 32 will itself become damaged in a short period of time, because the underlying cause of the damage still exists, namely the deviated well.

Figure 4:
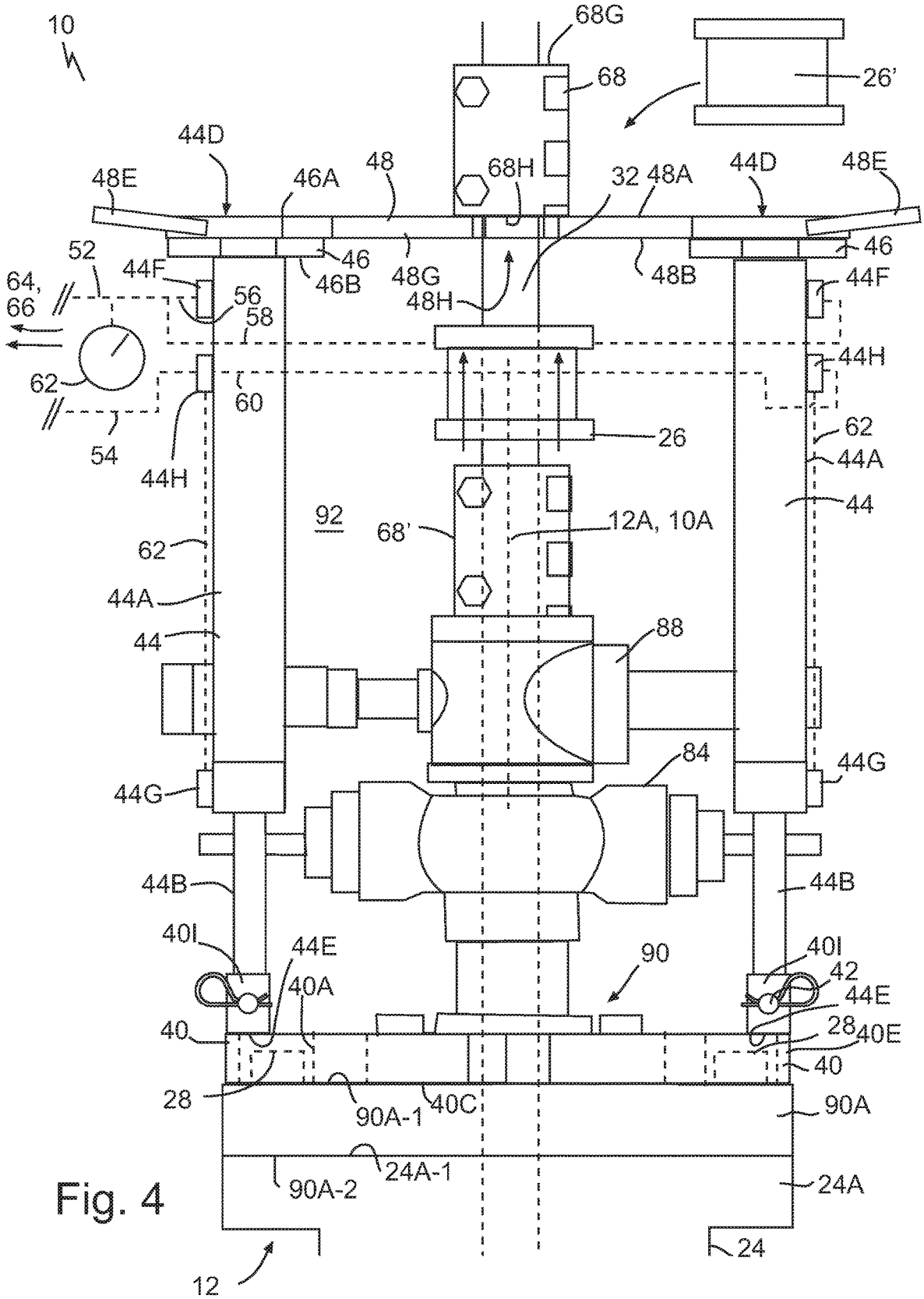
FIG. 4 is a side elevation view of the polished rod elevator and well head combination of FIG. 2, with the polished rod elevator supporting the polished rod while a second temporary rod clamp is installed below the stuffing box to permit the stuffing box to be removed or replaced.

Referring to FIGS. 2-4, the elevator 10 may be used to service a stuffing box 26 of a production tree 12. Referring to FIG. 2, a rod clamp 68 may be connected to the rod 32. Referring to FIG. 3, the actuators 44 of the elevator 10 may be extended, at least until the platform 48 contacts the base face 68H of the temporary rod clamp 68, supporting the weight of the rod 32 and string 33. Referring to FIG. 4, while the polished rod 32 is supported by the polished rod elevator 10, the stuffing box 26 may be disconnected, for example from the BOP 84, and slid up the polished rod 32. Prior to disconnecting the stuffing box 26, the well may be killed or the BOP 84 engaged to block fluid flow from the well. After the rod is picked up, the operator may close in the rod BOP 84, isolating the well, bleeding off everything above the BOP 84, back out the stuffing box, pick up the stuffing box up, slide it up the polished rod, put on the clamp 68', bring down the stroke so all the weight is on the clamp 68' or plate below the stuffing box 26, and thereafter the operator can use a small picker to remove everything above the clamp 68'.

A lower temporary rod clamp 68' may be connected to the polished rod 32 below the stuffing box 26. The top lift platform 48 may be released from around the polished rod 32, for example if the elevator 10 were disassembled or the platform 48 removed or tilted out of the way of the stuffing box 26. The stuffing box 26 may be slid off of a top end of the polished rod 32, for example after disconnecting the rod 32 from the carrier bar and permanent rod clamp. The stuffing box 26 may be serviced, for example the seals may be changed out and parts repaired, or a new stuffing box 26' may be used. The new or refurbished stuffing box 26' may be slid on the polished rod 32 above the lower temporary rod clamp 68'. The rod lift elevator 10 may be operated to cause the top lift platform 48 to support the polished rod 32. The lower temporary rod clamp 68' may be released. The stuffing box 26' may be secured to the production tree 12. Thus, the elevator 10 may be used to service or replace a stuffing box 26, without requiring a service rig.

Referring to FIGS. 2-3 and 5, the elevator 10 may be used to service a stuffing box 26 and/or BOP 84 of a production tree 12, or any other component of the production tree 12. The method for removing the BOP 84 and stuffing box 26 may be similar to the method for removing just the stuffing box 26. Referring to FIG. 5, while the polished rod 32 is supported by the polished rod elevator 10, a stuffing box 26 and rod blowout preventer 84 (along with flow manifold 88 in the example shown) are slid in the production tree 12 up the polished rod 32. A lower temporary rod clamp 68' is connected to the polished rod 32 below the rod blowout preventer 84. The top lift platform 48 may be released from around the polished rod 32. The stuffing box 26 and rod blowout preventer 84 may be slid off of a top end of the polished rod 32. The new or refurbished rod blowout preventer and the new or refurbished stuffing box may be slide on the polished rod 32 above the lower temporary rod clamp 68'. The rod lift elevator 10 may be operated to cause the top lift platform 48 to support the polished rod 32. The lower temporary rod clamp 68' may be removed. The rod blowout preventer 84 and the stuffing box 26 may be secured to the production tree 12.

Referring to FIG. 1, volumetric efficiency of a pump is reduced in wells that produce gas. The compression chamber between the standing and traveling one-way valves may fail to fill completely with liquid. Instead, the compression chamber contains undissolved gas, air or vacuum, which are collectively referred to herein as "gas". The gas may be undissolved from the liquid ("free gas") or it may be dissolved in the liquid ("solution gas") until subjected to a drop in pressure in an expanding compression chamber, wherein the gas may come out of solution. Gas may take the place of liquid in the compression chamber, reducing efficiency. The presence of gas in the compression chamber of the barrel 18A may reduce the efficiency of the pump 18, and increase lifting costs to produce the liquid to the surface 22. This condition is known as "gas interference".

The presence of too much gas in the compression chamber may in some cases completely eliminate the ability of the pump to lift fluid. This is because the gas in the compression chamber may prevent the contents therein from being compressed enough, to a pressure high enough, to overcome the hydrostatic pressure above on the traveling valve. This condition is known as "gas locked", and is a type of gas interference.

Operating the pump in a gas locked condition is undesirable because energy is wasted in that the pump is reciprocated but no fluid is lifted. The pump, sucker rod string, surface pumping unit, gear boxes and beam bearings may experience mechanical damage due to the downhole pump plunger hitting the liquid-gas interface in the compression chamber on the down stroke, creating hydraulic transient energy waves. Loss of liquid lift leads to rapid wear on pump components, as well as stuffing box seals. This is because such components are designed to be lubricated and cooled by the well liquid. Gas-locking, and implementation of a prior art solution for overcoming same, not only damages the pump and stuffing box, but can reduce the overall productivity of the well. Producing gas without the liquid component removes the gas from the well. The gas is needed to drive the liquid from the formation into the well bore.

Such failure to completely fill the chamber during gas locking or interference may be attributed to various causes. In a gas lock situation or a gas interference situation, the formation produces gas in addition to liquid. The gas is at the top of the chamber, while the liquid is at the bottom, creating a liquid-to-gas interface. If this interface is relatively high in the chamber, gas interference results. In gas interference, the plunger (on the down stroke) descends in the chamber and hits the liquid-to-gas interface. The change in resistances causes a mechanical shock or jarring. Such a shock damages the pump, the sucker rods and the tubing. If the liquid-to-gas interface is relatively low in the chamber, a gas lock may result, wherein insufficient pressure is built up inside of the chamber on the down stroke to open the plunger valve. The plunger is thus not charged with fluid and the pump is unable to lift anything.

In a pump off situation, the annulus surrounding the tubing down at the pump has a low fluid level, and consequently a low fluid head is exerted on the barrel valve. In an ideal pumping situation, when the plunger is on the upstroke, the annulus head pressure forces annulus fluid into the chamber. However, with a pump off condition, the low head pressure is unable to force enough fluid to completely fill the chamber. Consequently, the chamber has gas or air (a vacuum) therein. A pump (and its associated equipment) that is in a pump off condition suffers mechanical shock and jarring as the plunger passes through the liquid-to gas interface. A restricted intake can also cause pump off.

There are various ways to address gas locking. One response is to remove the oil pump 18 and release the trapped gas. This may be time-consuming and expensive, requiring the entire sucker rod string 33 to be removed. In extreme cases, a reciprocating pump may be replaced with a rotating surface drive coupled to a downhole progressive cavity pump, which experiences no gas lock. Again, such a method may be time-consuming and expensive.

Another approach is to adjust the stroke of the plunger to bottom out, or tap bottom, jarring the balls of the travelling and standing valves off of their valve seats to attempt to influence liquid flow when hydrostatic conditions under gas-locking are unfavorable. The adjustment of the pump requires a service visit and the extent of the tap is not always appreciated at surface when the impact actually occurs one or more kilometers downhole. Further it is understood that rather than have service personnel return multiple times in response to repeated gas-locking, a pump might actually be left configured to tap bottom continuously. Such a situation may result is damage over time to sucker rods, rod guides, pump plunger 18B and barrel 18A.

Referring to FIGS. 1-3, the elevator 10 may be used to address gas locking in the pump 18. As mentioned above, the carrier bar 38 may raise and lower the rod 32, and hence the string 33, using a permanent rod clamp 37 above the carrier bar 38. The position of the rod clamp 37 controls the stroke of the pump jack 14. Too high or low on the rod 32 and the pump stroke may be too short or may top or bottom out in contact with the pump. Referring to FIGS. 1 and 3, while the polished rod 32 is supported by the polished rod elevator 10. The permanent rod clamp 37 may be disengaged from the polished rod 32. The permanent rod clamp 37 may be initially located at a first position (shown in FIG. 1 in solid lines) above a carrier bar 38 of a pump jack 14. The plurality of linear actuators 44 may be extended or retracted to lift or lower, respectively, the polished rod 32. The permanent rod clamp 37 or a new permanent rod clamp 37 may be secured to the polished rod 32 in a new position (shown in dashed lines in FIG. 1) different from the first position to adjust a stroke of the polished rod 32. It may be desired to adjust the stroke length for various reasons, including seasonal expansions or retractions of the rod string 33 affecting calibrated pump stroke, or gas-lock addressing.

Figure 10:
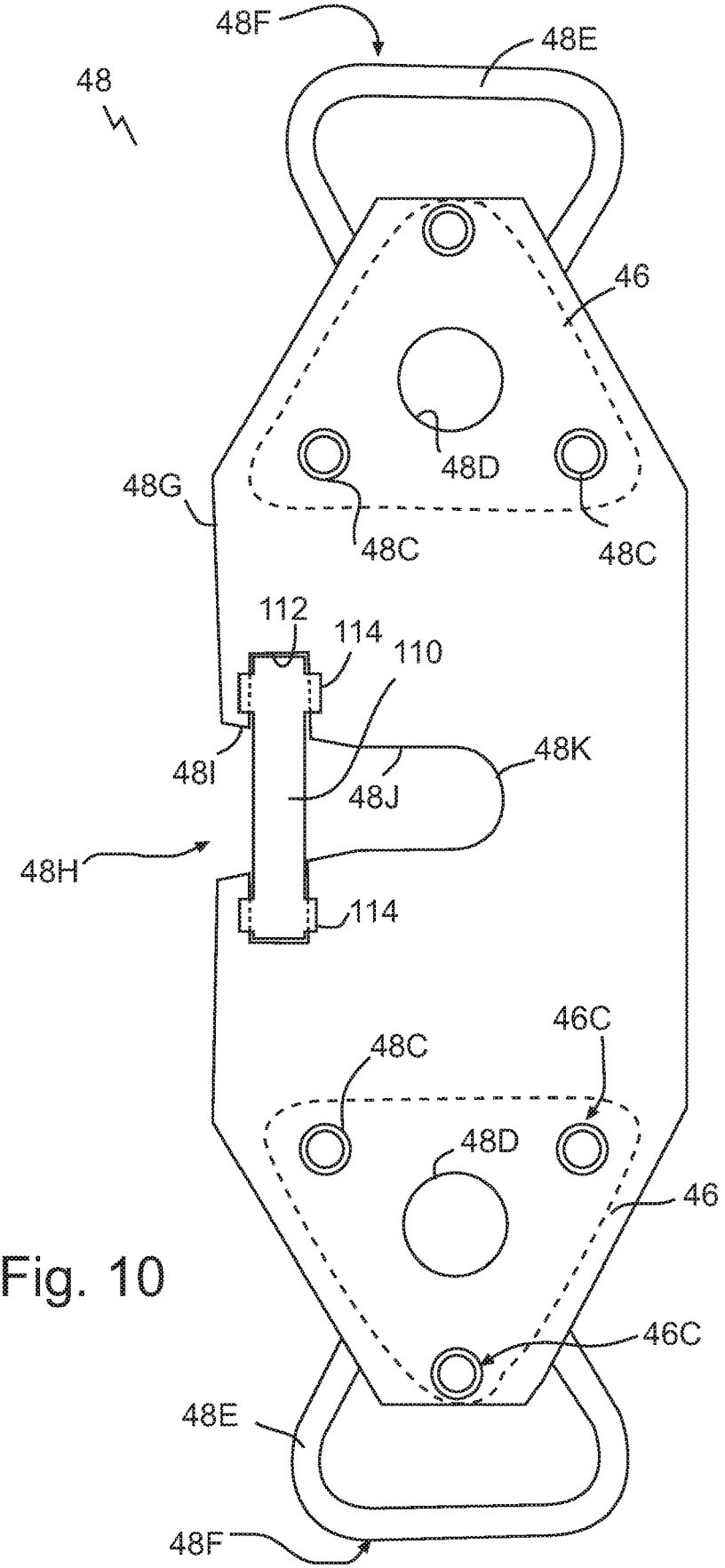
FIG. 10 is a top plan view of a further embodiment of a top lift platform used in the polished rod elevator of FIG. 2, with a slide-in gate plate to close the rod mouth.

Referring to FIGS. 6 and 10, the elevator 10 may be provided with a mechanism for closing the mouth 48H to enclose the rod therein. In the example shown a slide-in plate 110 may be slide vertically into a correspondingly-shaped slot 112 defined in the top lift platform 48. The gate plate 110 may be structured to next or sit within the slot 112, for example the plate 110 may comprise shoulders 114 that seat upon the top surface of the platform 48. The plate 110 may be removed to permit the rod to enter the mouth 48H, after which the plate 110 may be slid in to prevent the rod from leaving the mouth 48H, and when it is desired to remove the rod, the plate 110 may be removed to clear the mouth 48H of obstruction for the rod.

Referring to FIG. 1, the stroke may be adjusted to minimize, prevent, or stop gas locking. In one case, the stroke is adjusted such that the polished rod 32 soft taps a bottom hole pump 18 connected to the polished rod 32 at a base of the stroke. In some cases, the elevator may be used to find when rod guide and upper guide meet and touch, as such represents the base end of a pump stroke. The operator may from that position, want to pick the rod 32 up 10-14 inches so that the user is not tapping the top of the pump 18 downhole. In some cases, to address the gas locking the well may be put on soft tap. Conventionally, the pump jack 14 itself would be used to achieve this, for example by lowering the safety clamp 37, and hitting the stuffing box 26, allowing the rod string to lift up take weight off carrier bar. Such an approach has caused many accidents from putting the well on tap with this old method. A manual method may cause damage from the clamp hitting the stuffing box, from the brakes not holding properly on the pump jack, or from human error. The present elevators 10 may improve the safety of the stroke adjustment process. In normal pumping, the safety clamp 37 may be about 10 inches from the carrier bar 38, and what holds the rod string 33 is the clamp 37 above the carrier bar. The elevator 10 may be used to take weight off the top clamp 37, to back off lift so the user may move the rod string down to find a nice slight tap. When the slight tap is found, the user, may put the safety clamp 37 back where it is 10 inches from the bottom of the carrier bar 38. A full stroke of the pump 18 may be required to remove gas lock. The advantage of the present method over the old method may be that because you do not run the pump jack to set the tap, fewer issues may occur.

In the claims, the word "comprising" is used in its inclusive sense and does not exclude other elements being present. The indefinite articles "a" and "an" before a claim feature do not exclude more than one of the feature being present. Each one of the individual features described here may be used in one or more embodiments and is not, by virtue only of being described here, to be construed as essential to all embodiments as defined by the claims.

The embodiments of the invention in which an exclusive property or privilege is claimed are defined as follows:

1. A polished rod elevator comprising:

a top lift platform defining a polished rod passage and a mouth to laterally receive a polished rod into the polished rod passage;

a plurality of linear actuators depending below the top lift platform and radially spaced from an axis of the polished rod passage to define a production tree receiving gap; and a plurality of arcuate wellhead flange mounting base plates connected to base ends of the plurality of linear actuators; and in which each of the plurality of arcuate wellhead flange mounting base plates are recessed to receive an array of flange bolts from a wellhead flange in use.

2. The polished rod elevator of claim 1 in which each of the plurality of arcuate wellhead flange mounting base plates define an array of flange bolt receivers.

3. The polished rod elevator of claim 1 in which each of the plurality of arcuate wellhead flange mounting base plates form a semicircle arc.

4. The polished rod elevator of claim 3 in which the plurality of arcuate wellhead flange mounting base plates collectively form a ring.

5. The polished rod elevator of claim 1 further comprising a plurality of releasable connectors connecting the base ends of the plurality of linear actuators to the plurality of arcuate wellhead flange mounting base plates.

6. The polished rod elevator of claim 5 in which each of the plurality of arcuate wellhead flange mounting base plates have linear actuator receiving posts extending above a top face of the arcuate wellhead flange mounting base plate.

7. The polished rod elevator of claim 1 in which each of the linear actuators has a mounting plate secured at a top end of the linear actuator, with fasteners passed through the top lift platform into the mounting plate to secure the linear actuator to the top lift platform.

8. The polished rod elevator of claim 1 further comprising a load sensor.

9. The polished rod elevator of claim 1 in which there are two linear actuators and two arcuate wellhead flange mounting base plates.

10. The polished rod elevator of claim 1 mounted to a tubing bonnet flange with a production tree received within the production tree receiving gap between the plurality of linear actuators.

11. The polished rod elevator of claim 10 in which the top lift platform contacts a rod clamp on the polished rod to support the weight of and to lift the polished rod.

12. A kit comprising the parts of the polished rod elevator of claim 1 disconnected from one another.

13. A method comprising:

arranging a polished rod elevator on a wellhead, such that:

arcuate flange mounting base plates seat upon a flange of the wellhead, linear actuators extend upward from each arcuate flange mounting base plate, and a top lift platform mounts to respective top ends of the plurality of linear actuators, with a polished rod extending out of a production tree on the wellhead and through a polished rod passage defined in the top lift platform; and extending the plurality of linear actuators to cause the top lift platform to lift the polished rod relative to the arcuate flange mounting base plates.

14. The method of claim 13 further comprising connecting a temporary rod clamp to the polished rod above the top lift platform, in which during extending the top platform contacts the temporary rod clamp to one or more of lift or support the polished rod.

15. The method of claim 13 further comprising:

while the polished rod is supported by the polished rod elevator, sliding a stuffing box in the production tree up the polished rod;

connecting a lower temporary rod clamp to the polished rod below the stuffing box;

releasing the top lift platform from around the polished rod; and sliding the stuffing box off of a top end of the polished rod.

16. The method of claim 15 further comprising:

placing a serviced or new stuffing box on the polished rod above the lower temporary rod clamp;

operating the rod lift elevator to cause the top lift platform to support the polished rod;

removing the lower temporary rod clamp; and securing the serviced or new stuffing box to the production tree.

17. The method of claim 13 further comprising:

while the polished rod is supported by the polished rod elevator, sliding a stuffing box and rod blowout preventer in the production tree up the polished rod;

connecting a lower temporary rod clamp to the polished rod below the rod blowout preventer;

releasing the top lift platform from around the polished rod; and sliding the stuffing box and rod blowout preventer off of a top end of the polished rod.

18. The method of claim 17 further comprising:

placing a) the rod blowout preventer or a new rod blowout preventer and b) the stuffing box or a new stuffing box, on the polished rod above the lower temporary rod clamp;

operating the rod lift elevator to cause the top lift platform to support the polished rod;

removing the lower temporary rod clamp; and securing the rod blowout preventer and the stuffing box to the production tree.

19. The method of claim 13 further comprising:

while the polished rod is supported by the polished rod elevator, disengaging a permanent rod clamp from the polished rod, the permanent rod clamp being located at a first position above a carrier bar of a pump jack;

securing the permanent rod clamp or a new permanent rod clamp to the polished rod in a new position different from the first position to adjust a stroke of the polished rod.

20. The method of claim 19 in which:

the stroke is adjusted such that the polished rod soft taps a bottom hole pump connected to the polished rod at a base of the stroke; or the plurality of linear actuators are operated to remove a gas lock in a bottom hole pump connected to the polished rod.

21. The method of claim 13 in arranging further comprises:

assembling the arcuate flange mounting base plates about a tubing bonnet flange of the wellhead;

connecting the linear actuators to the arcuate flange mounting base plates; and connecting the top lift platform to the top ends of the linear actuators.

22. A method comprising:

arranging a polished rod elevator on a wellhead, such that:

arcuate flange mounting base plates seat upon a flange of the wellhead, linear actuators extend upward from each arcuate flange mounting base plate, and a top lift platform mounts to respective top ends of the plurality of linear actuators, with a polished rod extending out of a production tree on the wellhead and through a polished rod passage defined in the top lift platform;

extending the plurality of linear actuators to cause the top lift platform to one or more of lift or support the polished rod;

while the polished rod is supported by the polished rod elevator, sliding a stuffing box in the production tree up the polished rod;

connecting a lower temporary rod clamp to the polished rod below the stuffing box;

releasing the top lift platform from around the polished rod; and sliding the stuffing box off of a top end of the polished rod.

23. A method comprising:

arranging a polished rod elevator on a wellhead, such that:

arcuate flange mounting base plates seat upon a flange of the wellhead, linear actuators extend upward from each arcuate flange mounting base plate, and a top lift platform mounts to respective top ends of the plurality of linear actuators, with a polished rod extending out of a production tree on the wellhead and through a polished rod passage defined in the top lift platform;

extending the plurality of linear actuators to cause the top lift platform to one or more of lift or support the polished rod;

while the polished rod is supported by the polished rod elevator, sliding a stuffing box and rod blowout preventer in the production tree up the polished rod;

connecting a lower temporary rod clamp to the polished rod below the rod blowout preventer;

releasing the top lift platform from around the polished rod; and sliding the stuffing box and rod blowout preventer off of a top end of the polished rod.

* * * * *